United States Patent [19]

Cousineau et al.

[11] Patent Number: 5,027,905

[45] Date of Patent: Jul. 2, 1991

[54] FIRE SPRINKLER CONTROL APPARATUS

[76] Inventors: Ronald L. Cousineau, 12542 - 53 Street, Edmonton, Alberta, Canada T5W 34; Denis Normand, P.O. Box 7373, Bonnyville, Alberta, Canada T9N 2H7

[21] Appl. No.: 385,090

[22] Filed: Jul. 26, 1989

[51] Int. Cl.[5] ..... A62C 35/00

[52] U.S. Cl. ..... 169/17; 169/16; 169/19

[58] Field of Search ..... 169/16, 17, 19; 137/207

[56] References Cited

U.S. PATENT DOCUMENTS

| | | | |
|---|---|---|---|
| 1,246,798 | 11/1917 | Thompson | 169/16 |
| 3,759,331 | 9/1973 | Livingston | 169/17 |
| 3,834,462 | 9/1974 | Orloff et al. | 169/17 |
| 3,921,722 | 11/1975 | Query | 169/16 |
| 4,330,040 | 5/1982 | Ence et al. | 169/16 |
| 4,345,715 | 8/1982 | Van Craenenbroeck | 157/207 |
| 4,697,643 | 10/1987 | Sassier | 169/75 |
| 4,785,666 | 11/1988 | Bergquist | 73/40.7 |

FOREIGN PATENT DOCUMENTS

| | | |
|---|---|---|
| 18832 | 2/1884 | Canada . |
| 286269 | 1/1929 | Canada . |
| 361143 | 10/1936 | Canada . |
| 409763 | 1/1943 | Canada . |
| 427332 | 5/1944 | Canada . |
| 445331 | 12/1947 | Canada . |
| 832257 | 1/1970 | Canada . |
| 1152857 | 8/1983 | Canada . |

*Primary Examiner*—Joseph F. Peters, Jr.
*Assistant Examiner*—Christopher P. Ellis
*Attorney, Agent, or Firm*—Marjama & Pincelli

[57] ABSTRACT

A fire sprinkler control apparatus which is adapted for connection between a network of connecting fluid flow lines which terminate in sprinkler heads and a water supply. The apparatus consists of a conduit having a first end and a second end. The first end is secured to a water supply and the second end is secured to a network of connecting lines. A solenoid valve is positioned at the first end of the conduit such that the flow of water from the water supply through the conduit to the connecting lines is controlled. An expansion tank is connected to the conduit. A sniffer valve is provided for coupling the conduit to an air source, such that the conduit, the expansion tank and all connecting lines may be pressurized with gas. A pressure switch is connected to the solenoid valve and with the conduit. The solenoid valve is opened to release water from the water supply into the conduit should the pressure in the conduit drop below a preset level.

9 Claims, 1 Drawing Sheet

FIRE SPRINKLER CONTROL APPARATUS

The present invention relates to a fire sprinkler control apparatus.

BACKGROUND OF THE INVENTION

There has been a reluctance on the part of persons living in cold climates to install fire sprinkler systems in their premises, where the connecting fluid flow lines must be positioned in exterior walls. The reason for this reluctance is that fluid in exterior walls may freeze and burst the fluid flow lines resulting in extensive damage.

SUMMARY OF THE INVENTION

What is required is a fire sprinkler control apparatus which releases water into connecting fluid flow lines only when water is required to extinguish a fire.

According to the present invention there is provided a fire sprinkler control apparatus which is adapted for connection between a network of connecting fluid flow lines which terminate in sprinkler heads and a water supply. The apparatus is comprised of a conduit having a first end and a second end, such that the first end may be secured to a water supply and the second end may be secured to a network of connecting lines. A valve is positioned at the first end of the conduit such that the flow of water from the water supply through the conduit to the connecting lines is controlled. An expansion tank is secured to and communicates with the conduit. Means is provided for coupling the conduit to an air source, such that the conduit, the expansion tank and all connecting lines may be pressurized with gas. A pressure switch is connected to the valve and the conduit. The valve is opened to release water from the water supply into the conduit should the pressure in the conduit drop below a preset level.

The described fire sprinkler control apparatus releases water into the connecting fluid flow lines only when water is required to extinguish a fire. The expansion and contraction of the volume of pressurized air in the system which occurs with temperature fluctuations is accommodated through the use of the expansion tank. Water is introduced into the system only when a drop in pressure in the conduit causes the pressure switch to activate the valve.

Although beneficial results may be obtained by using the fire sprinkler control apparatus as described above, there is a danger that a leak in the system may cause pressure levels to drop below the preset level thereby triggering the release of water. A release of water in the absence of a fire would fill the fluid flow lines with water as the sprinkler heads would remain closed. Having the fluid flow lines filled with water exposes the pipes to the consequential risk of freezing. Even more beneficial results may therefore be obtained by having a buzzer and a secondary pressure switch connected to both the buzzer and the conduit, such that the buzzer is activated to emit a warning tone should the pressure in the conduit drop below a preset level.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
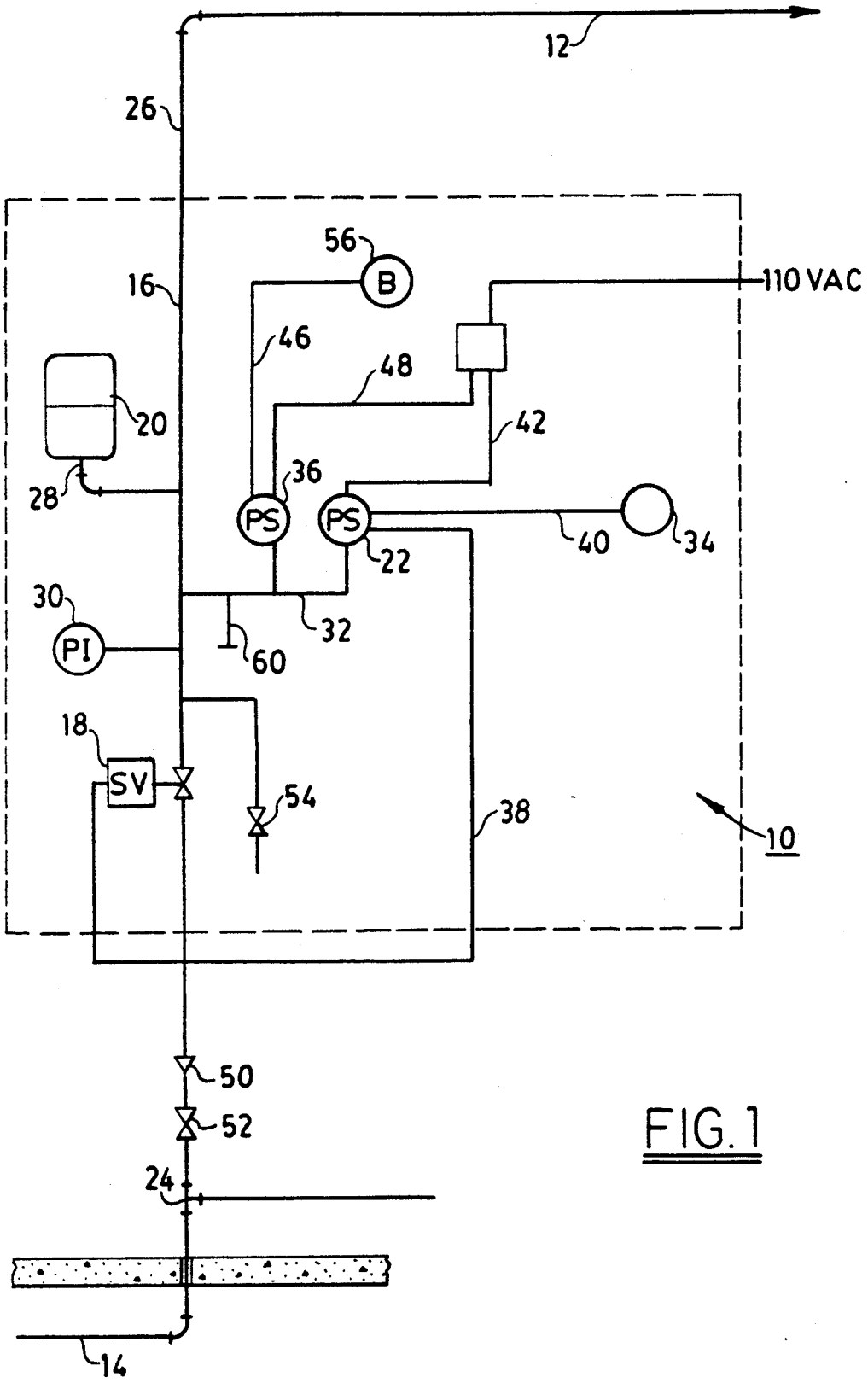
FIG. 1 is a schematic diagram of a preferred embodiment of the invention.

The preferred embodiment will now be described with reference to FIG. 1. The preferred embodiment, generally designated by reference numeral 10, is a fire sprinkler control apparatus which is adapted for connection between a network of connecting fluid flow lines 12 which terminate in sprinkler heads (not shown) and a water supply 14. The main components of fire sprinkler control apparatus 10 are a conduit 16, a solenoid valve 18, an expansion tank 20 and a primary pressure switch 22.

Conduit 16 designates the primary water flow path. No water can flow from water supply 14 to connecting fluid flow lines 12 leading to the sprinkler heads without passing through conduit 16. Conduit 16 has a first end 24 and a second end 26. First end 24 is to be secured to water supply 14. Second end 26 is to be secured to connecting fluid flow lines 12. Solenoid valve 18 is positioned at first end 24 of conduit 16. No water may flow from water supply 14 through conduit 16 to connecting fluid flow lines 12 when solenoid valve 18 is closed. Expansion tank 20 is secured to conduit 16 by connecting line 28. The purpose of expansion tank 20 will be hereinafter described in connection with the operation of apparatus 10. A connecting line 32 leads from conduit 16 to primary pressure switch 22 and a secondary pressure switch 36. A sniffer valve 60 is also positioned on connecting line 32. Primary pressure switch 22 is connected by electric cable 38 to solenoid valve 18, by electrical cable 40 to a alarm bell 34 and by electrical cable 42 to a power source (not shown). Secondary pressure switch 36 is connected by electrical cable 46 to a buzzer 56 and by electrical cable 48 to a power source (not shown). A dual back flow preventer 50 is positioned at first end 24 of conduit 16. A manual shut off valve 52 is positioned at first end 24 of conduit 16 adjacent water supply 14. A drain 54 is secured at first end 24 of conduit 16. A pressure indicator gauge 30 is secured to conduit 16.

The use and operation of fire sprinkler control apparatus 10 will now be described with reference to FIG. 1. Solenoid valve 18 should be placed in a closed position, such that no water from water supply 14 can enter into conduit 16. Sniffer valve 60 is then coupled to an air source (not shown) in order that connecting lines 28 and 32, conduit 16, expansion tank 20 and connecting fluid flow lines 12 may be pressurized with air. The preferred pressure level is 60 pounds per square inch. The pressure level in conduit 16 can be checked with reference to gauge 30, as the pressure in connecting line 32 and the pressure exerted against primary pressure switch 22 is the same as in conduit 16. Should the pressure level in conduit 16 drop below 25 pounds per square inch primary pressure switch 22 activates solenoid valve 18. As solenoid valve 18 opens water is released from water supply 14 into conduit 16 and via conduit 16 to connecting fluid flow lines 12 which lead to the sprinkler heads (not shown). At the same time as solenoid valve 18 is activated, alarm bell 34 is also activated to warn occupants of the residence. It must be noted the important role played by expansion tank 20. The volume of air in the system varies with temperature. An increase in temperature results in the expansion of the air, and expansion tank 20 provides the space necessary for such expansion.

Secondary pressure switch 36 is provided as a precautionary measure. Should the pressure in conduit 16 drop below 50 pounds per square inch secondary pressure switch 36 activates buzzer 56 which emits a warning tone. The warning tone indicates that a slow pressure leak has developed. This permits systems maintenance to be performed before water is released into fluid flow lines 12.

Once primary pressure switch 22 has activated solenoid valve 18 and water from water supply 14 has flowed through conduit 16 to connecting fluid flow lines 12, the remaining features are used in resetting the system. Back flow preventer 50 prevents water in connecting fluid flow lines 12 and conduit 16 from flowing back to water supply 14. This is important in applications where a back flow of water could contaminate the water supply. Manual shut off valve 52 permits the supply of water to conduit 16 to be shut off once a fire is extinguished in order that solenoid valve 18 may be reset to a closed position. Drain 54 permits conduit 16 and connecting fluid flow lines 12 to be drained of water once a fire is extinguished, in order that the system may again be pressurized.

It will be apparent to one skilled in the art that modifications may be made to fire sprinkler control apparatus 10 without departing from the spirit and scope of the invention. In particular, many of the preferred features may be removed while still leaving apparatus 10 functional. In additional alternate types of switches and valves may be used having regard to the intended function. Similarly, the arrangement of components may be configured in a different manner having regard to the intended function.

The embodiments of the invention in which an exclusive property or privilege is claimed are defined as follows:

1. A fire sprinkler control apparatus which is adapted for connection between a network of connecting fluid flow lines which terminate in sprinkler heads and a water supply, comprising:

a. a conduit having a first end and a second end, such that the first end may be secured to a water supply and the second end may be secured to a network of connecting fluid flow lines;

b. a valve positioned at the first end of the conduit such that the flow of water from the water supply through the conduit to the connecting fluid flow lines is controlled;

c. an expansion tank secured to and communicating with the conduit;

d. means for coupling the conduit to an air source, such that the conduit, the expansion tank and all connecting fluid flow lines may be pressurized with gas; and e. a pressure switch connected to the valve and the conduit, whereby the valve is opened to release water from the water supply into the conduit should the pressure in the conduit drop below a preset level.

2. A fire extinguisher control apparatus as defined in claim 1, the pressure level being set at 25 pounds per square inch.

3. A fire extinguisher control apparatus as defined in claim 1, having a buzzer and a secondary pressure switch connected to the buzzer and the conduit, such that the buzzer is activated to emit a warning tone should the pressure in the conduit drop below a preset level.

4. A fire extinguisher control apparatus as defined in claim 1, having a manual shut off valve whereby the supply of water to the conduit may be shut off once a fire is extinguished.

5. A fire extinguisher control apparatus as defined in claim 1, having a drain such that the conduit may be drained once a fire is extinguished.

6. A fire extinguisher control apparatus as defined in claim 1, having a double back flow preventer such that water in connecting fluid flow lines is prevented from flowing back to the water supply.

7. A fire extinguisher control apparatus as defined in claim 1, having a gauge secured to the conduit whereby a reading may be obtained as to the pressure level in the conduit.

8. A fire sprinkler control apparatus which is adapted for connection between a network of connecting fluid flow lines which terminate in sprinkler heads and a water supply, comprising:

a. a conduit having a first end and a second end, such that the first end may be secured to a water supply and the second end may be secured to a network of connecting fluid flow lines;

b. a solenoid valve positioned at the first end of the conduit such that the flow of water from the water supply through the conduit to the connecting fluid flow lines is controlled;

c. an expansion tank secured to and communicating with the conduit;

d. means for coupling the conduit to an air source, such that the conduit, the expansion tank and all connecting fluid flow lines may be pressurized with gas;

e. a primary pressure switch connected to the solenoid valve and the conduit, such that the solenoid valve is opened to release water from the water supply into the conduit should the pressure in the conduit drop below a preset level;

f. a buzzer; and g. a secondary pressure switch connected to the buzzer and the conduit, such that the buzzer is activated to emit a warning tone should the pressure in the conduit drop below a preset level.

9. A fire sprinkler control apparatus which is adapted for connection between a network of connecting fluid flow lines which terminate in sprinkler heads and a water supply, comprising:

a. a conduit having a first end and a second end, such that the first end may be secured to a water supply and the second end may be secured to a network of connecting fluid flow lines;

b. a solenoid valve positioned at the first end of the conduit such that the flow of water from the water supply through the conduit to the connecting fluid flow lines is controlled;

c. an expansion tank secured to and communicating with the conduit;

d. a sniffer valve secured to the conduit such that the conduit may be coupled to an air source, whereby the conduit, the expansion tank and all connecting fluid flow lines may be pressurized with gas;

e. a gauge secured to the conduit whereby a reading may be obtained as to the pressure level in the conduit;

f. a primary pressure switch connected to the solenoid valve and the conduit, such that the solenoid valve is opened to release water from the water supply into the conduit should the pressure in the conduit drop below 25 pounds per square inch;

g. a buzzer;

h. a secondary pressure switch connected to the buzzer and the conduit, such that the buzzer is activated to emit a warning tone should the pressure in the conduit drop below 50 pounds per square inch;

i. a double back flow preventer such that water in connecting fluid flow lines is prevented from flowing back to the water supply;

j. a manual shut off valve secured to the first end of the conduit whereby the supply of water to the conduit may be shut off once a fire is extinguished; and k. a drain secured to the conduit such that the conduit may be drained of water once a fire is extinguished;

* * * * *